US005497563A

United States Patent [19]

Mayfield

[11] Patent Number: 5,497,563

[45] Date of Patent: Mar. 12, 1996

[54] DRYER APPARATUS

[75] Inventor: Alfred B. Mayfield, Halstead, Kans.

[73] Assignee: Charles D. Johnson, McPherson, Kans.; a part interest

[21] Appl. No.: 239,257

[22] Filed: May 5, 1994

[51] Int. Cl.[6] ..... F26B 21/06

[52] U.S. Cl. ..... 34/572; 34/82; 34/88

[58] Field of Search ..... 34/82, 87, 88, 34/572; 55/210

[56] References Cited

U.S. PATENT DOCUMENTS

| | | | |
|---|---|---|---|
| 2,644,246 | 7/1953 | Robinson | 34/82 |
| 2,776,826 | 1/1957 | Bennett et al. | 34/87 |
| 2,950,539 | 8/1960 | Stevenson et al. | 34/82 |
| 3,579,851 | 5/1971 | Elmy | 34/82 |

FOREIGN PATENT DOCUMENTS

| | | | |
|---|---|---|---|
| 395598 | 10/1990 | European Pat. Off. | 34/87 |
| 2715960 | 10/1978 | Germany | 34/82 |
| 63-319000 | 12/1988 | Japan | 34/572 |

*Primary Examiner*—Edward K. Look
*Assistant Examiner*—James A. Larson
*Attorney, Agent, or Firm*—Hovey, Williams, Timmons & Collins

[57] ABSTRACT

A clothes dryer including a control circuit for controlling the operation of the dryer and for preventing the dryer from operating unless the dryer lint screen is cleaned periodically. The control circuit disables the dryer either after every drying cycle, after a predetermined amount of time, or after the lint filter becomes clogged. The control circuit re-enables the dryer after the lint screen has been removed from the lint screen compartment and cleaned.

19 Claims, 3 Drawing Sheets

DRYER APPARATUS

BACKGROUND OF THE INVENTION

1. Field of the Invention

The present invention relates to clothes dryers, and more particularly to a control circuit for controlling the operation of a clothes dryer and for preventing the dryer from operating unless the dryer lint screen is cleaned periodically.

2. Description of the Prior Art

During drying cycles, lint and other cloth particles are dislodged from clothes. Conventional clothes dryers include lint screens for filtering lint and other particles from the dryer. Lint screens filter the heated air generated by the dryer during operation, thus capturing these lint particles and preventing lint from accumulating on clothes.

Although lint screens are effective at removing particles from the dryer, they became clogged with lint quickly and therefore must be cleaned frequently in order to function effectively. Unfortunately, users often don't clean lint screens at frequent intervals.

When a lint screen becomes clogged with lint, several problems arise. First, a clogged lint screen decreases the efficiency of a dryer, resulting in increased energy consumption. A clogged lint screen reduces the efficiency of the dryer because the dryer must work harder to circulate the same volume of heated air. Second, clogged lint screen decreases the life of a dryer because the dryer must operate for longer drying cycles to thoroughly dry the clothes. The longer drying cycles cause the dryer to wear prematurely. Third, clogged lint screens often result in poorly dried clothes because the drying cycle ends prematurely. Finally, clogged lint screens cause dryer heating elements to overheat due to restricted air flow. This causes the heating elements to burn out prematurely and contributes to increased fire hazards. Clogged lint screens pose an acute problem in commercial cleaning operations because commercial dryers are operated numerous times each day and users rarely clean the lint screens between drying cycles.

Thus, there exists a need for a dryer which operates more safely and efficiently, uses less energy, dries clothes faster and more completely, and lasts longer. A need also exists for a control circuit for controlling the operation of a clothes dryer and for preventing the dryer from operating unless the lint screen is cleaned periodically.

SUMMARY OF THE INVENTION

It is an object of the invention to provide a dryer which operates more efficiently, uses less energy, dries clothes faster and more completely, and lasts longer.

It is another object of the invention to provide a control circuit for controlling the operation of a clothes dryer and for preventing the dryer from operating unless the lint screen is cleaned either after every drying cycle, after a predetermined amount of time, or after the lint filter becomes clogged.

In accordance with these and other objects evident from the following description of the invention, a clothes dryer is provided including a laundry compartment for receiving laundry to be dried, an air passageway coupled to the laundry compartment for circulating heated air generated by the clothes dryer in and out of the laundry compartment, a lint screen assembly interposed in the air passageway for filtering the circulated heated air, and a control circuit for controlling the operation of the dryer and for preventing the dryer from operating unless the lint screen is removed from the lint screen compartment and cleaned periodically. The preferred control circuit broadly includes a filter switch located in the lint screen compartment for determining the presence of the lint screen in the lint screen compartment, a disabling circuit coupled to the dryer timer for disabling the dryer after the completion of a drying cycle, and an enabling circuit coupled and responsive to the filter switch for enabling the operation of the clothes dryer after the lint screen has been removed and cleaned after a drying cycle. In operation, the components of the dryer control circuit cooperate to disable the clothes dryer after a drying cycle and re-enable the dryer after the lint screen has been removed.

In a second embodiment of the invention, the disabling circuit disables the dryer after the dryer has operated for a predetermined length of time. In a third embodiment of the invention, the control circuit includes an optical sensing circuit coupled to the disabling circuit for sensing when the lint screen is dirty. When the lint screen becomes clogged with lint and other particles, the optical sensing circuit activates the disabling circuit for disabling the dryer.

The present invention provides numerous advantages. For example, the control circuit disables the dryer either after every drying cycle, after a predetermined amount of time, or after the lint filter becomes clogged. The control circuit re-enables the dryer only after the lint screen has been removed and cleaned. As a result, the dryer operates more safely and efficiently, uses less energy, and dries clothes faster and more completely. Moreover, the invention increases the life of the dryer because the dryer heating elements don't overheat and overall operating time is reduced.

BRIEF DESCRIPTION OF THE DRAWING FIGURES

A preferred embodiment of the present invention is described in detail below with reference to the attached drawing figures, wherein.

DETAILED DESCRIPTION OF THE PREFERRED EMBODIMENT

Figure 4:
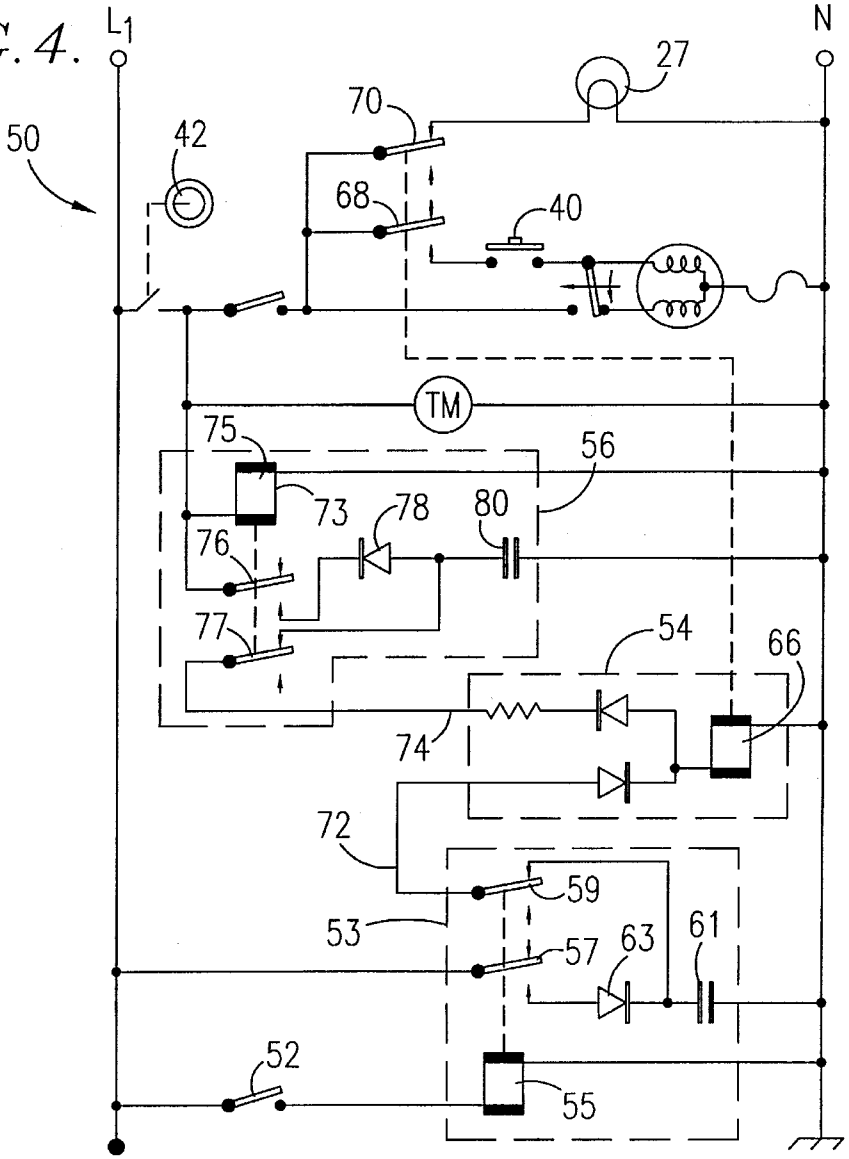
FIG. 4 is an electrical circuit diagram of a first embodiment of the dryer control circuit.
Figure 1:
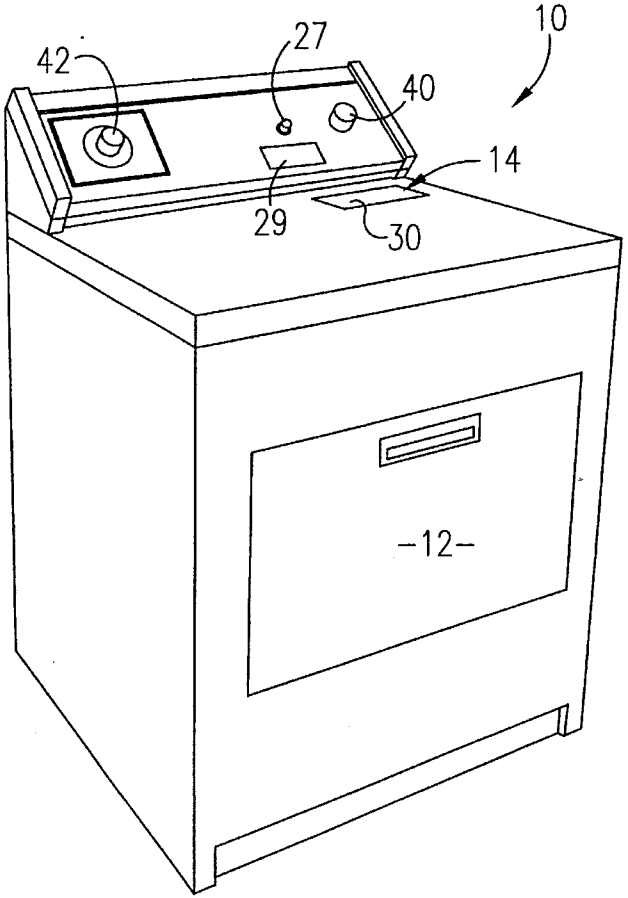
FIG. 1 is a pictorial view of a typical clothes dryer constructed in accordance with a preferred embodiment of the invention.
Figure 2:
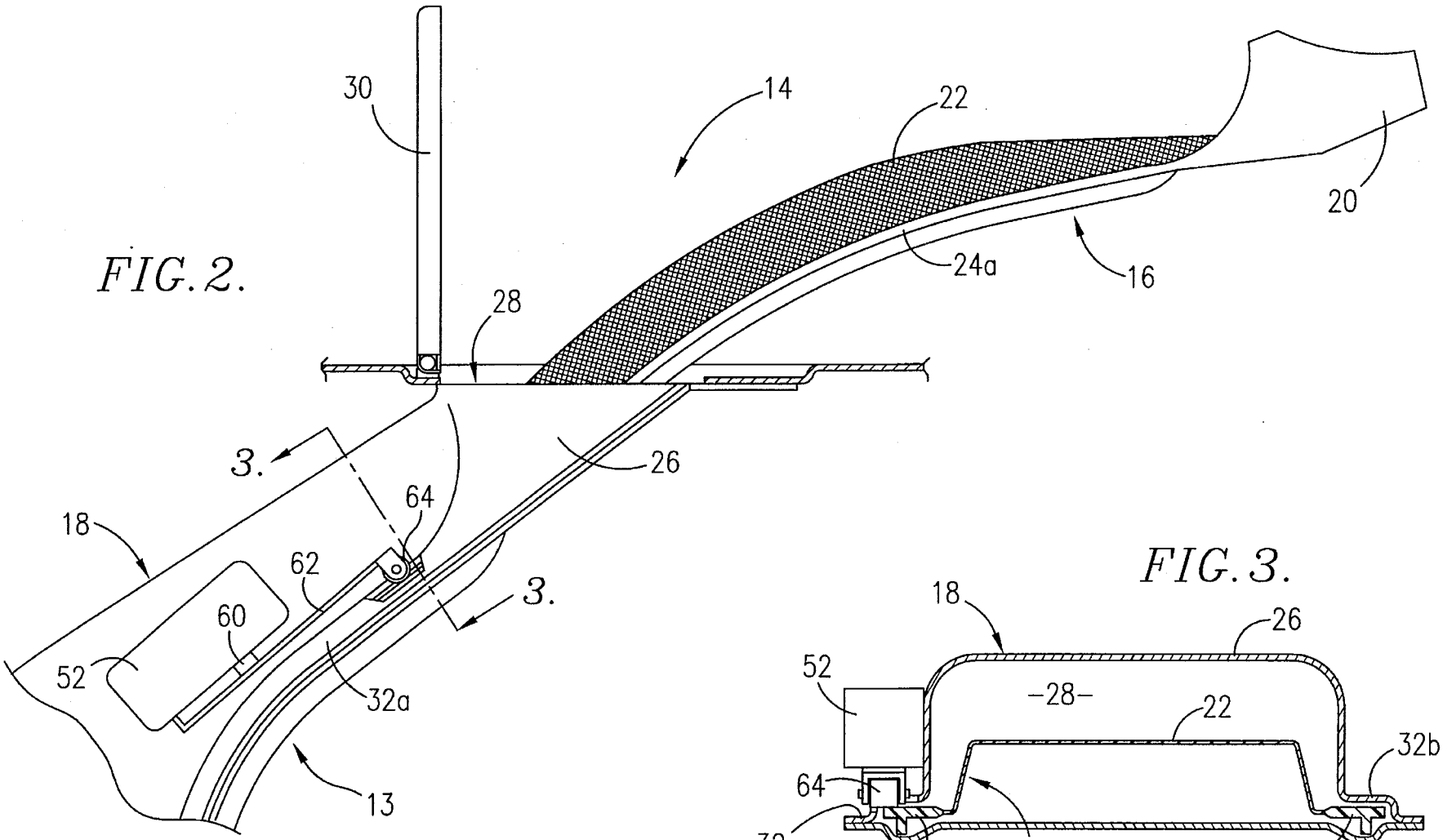
FIG. 2 is a side elevational view of a lint screen compartment and lint screen shown removed from the dryer, illustrating the placement of a filter switch.

Turning now to the drawings, and particularly FIGS. 1 and 2, the preferred dryer apparatus 10 broadly includes a laundry compartment 12, an air passageway 13, and a lint screen assembly 14. As illustrated in FIG. 4, the preferred dryer apparatus also includes a control circuit 50 for controlling the operation of the dryer.

Laundry compartment 12 is a conventional dryer basket configured for receiving damp or wet laundry. As illustrated in FIG. 2, air passageway 13 is in fluid communication with laundry compartment 12 and is configured for recirculating heated air generated by dryer apparatus 10 in and out of laundry compartment 12.

Lint screen assembly 14 is interposed in air passageway 13 for filtering air-borne particles such as lint from dryer apparatus 10. As illustrated in FIG. 2, the preferred lint screen assembly 14 includes lint screen 16 and lint screen compartment 18.

Figure 3:
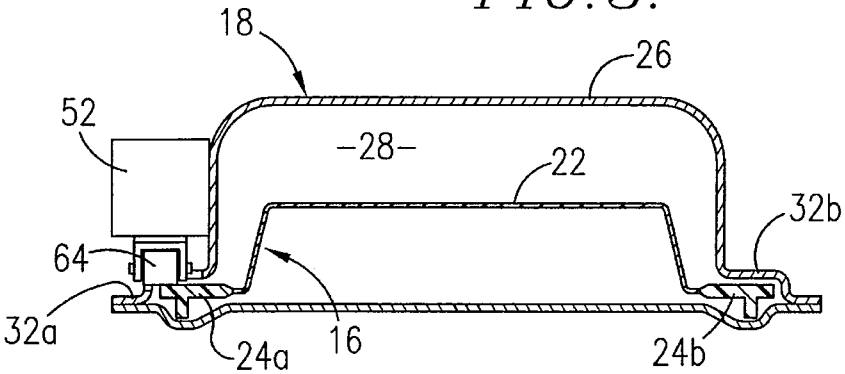
FIG. 3 is a sectional view of the lint screen compartment and filter switch taken along line 3—3 of FIG.

As illustrated in FIGS. 2 and 3, lint screen 16 includes a handle 20, a mesh or screen covering 22 and a pair of support rails 24*a* and 24*b*. Mesh 22 is a conventional metal screen and is stretched between handle 20 and support rails 24*a* and 24*b* for forming a screen which is previous to air but impervious to air-borne particles such as lint.

As illustrated in FIG. 2, lint screen compartment 18 is interposed in air passageway 13 and includes a housing 26 defining a longitudinally extending cavity 28 for receiving lint screen 16. Housing 26 includes a cover 30 and pair of guide rails 32*a* and 32*b* for receiving support rails 24*a* and 24*b*, respectively, of lint screen 18. Lint screen 16 is mounted in lint screen compartment 18 by opening cover 30 and slidingly engaging the screen in cavity 28.

Figure 6:
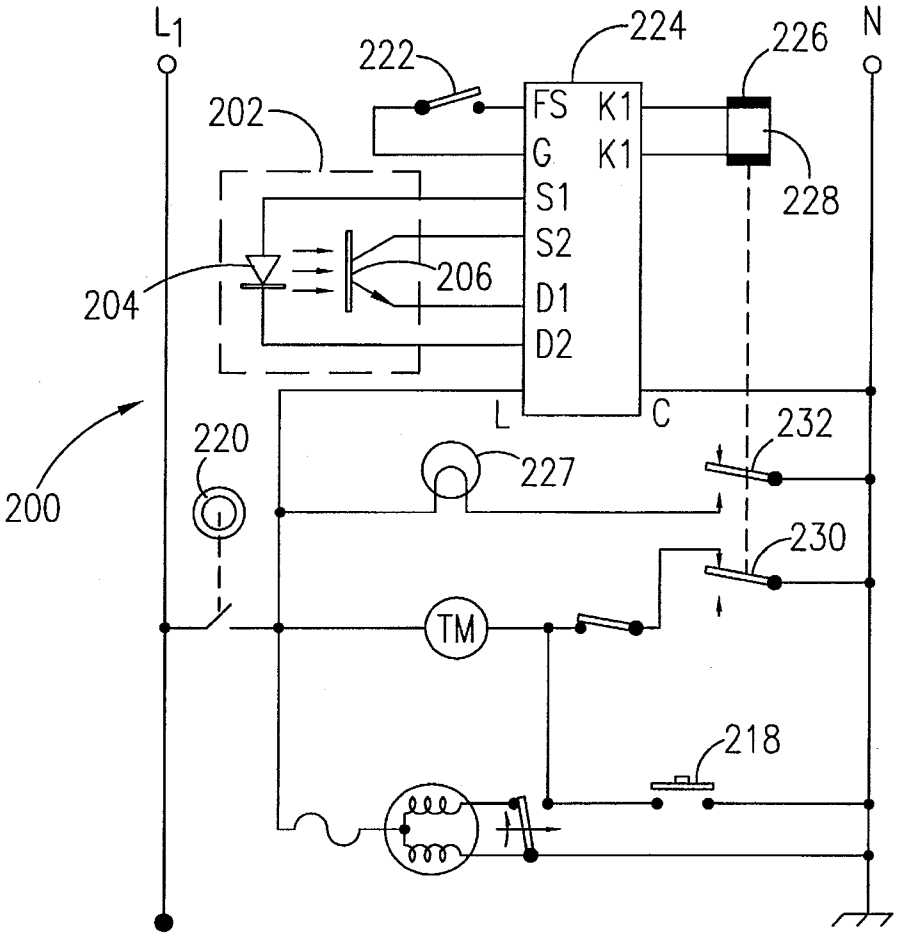
FIG. 6 is an electrical circuit diagram of a third embodiment of the dryer control circuit.
Figure 5:
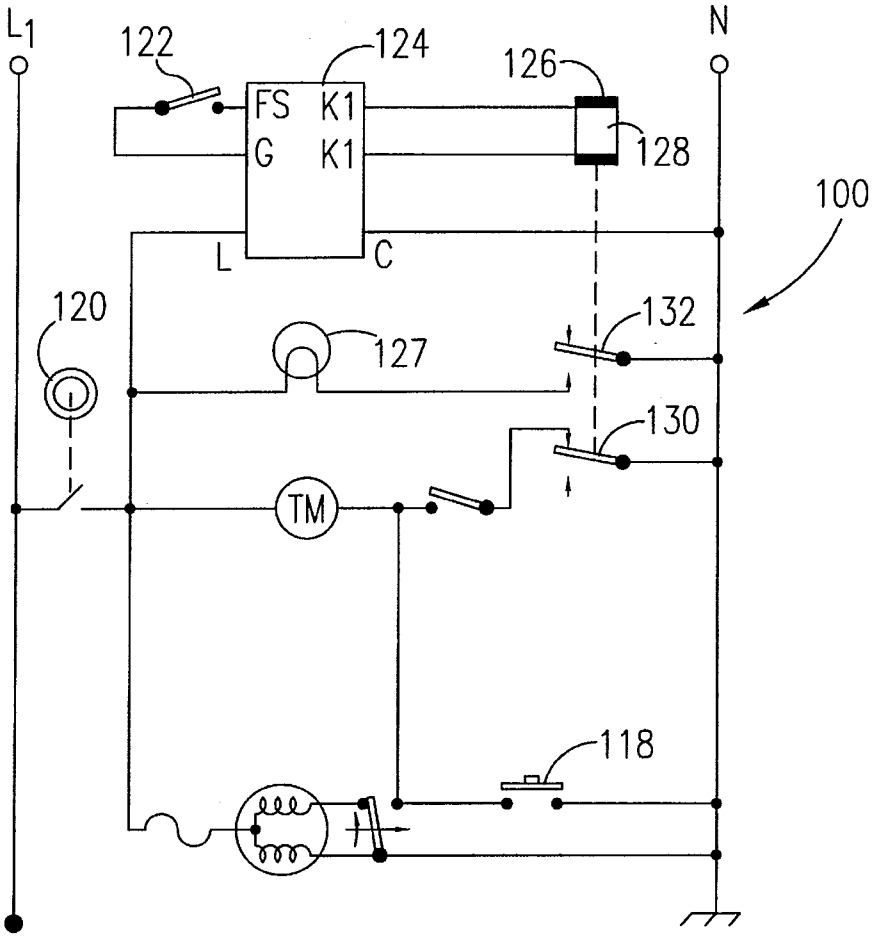
FIG. 5 is an electrical circuit diagram of a second embodiment of the dryer control circuit.

The control circuits illustrated in FIGS. 4, 5 and 6 control the operation of dryer 10 and prevent dryer 10 from operating unless lint screen 16 is cleaned periodically. The three preferred embodiments of the control circuit disable the dryer either after every drying cycle, after a predetermined amount of time, or after the lint screen becomes clogged.

FIG. 4 illustrates control circuit 50 which prevents dryer 10 from operating unless lint screen 16 is cleaned after every drying cycle. Control circuit 50 is electrically coupled to a conventional start button 40 and timer switch 42 and includes filter switch 52, relay assembly 53, enabling circuit 54, and disabling circuit 56. In preferred forms, control circuit 50 also includes a filter indicator light 27 mounted on the control panel of dryer apparatus 10 for indicating when dryer 10 is disabled and lint screen 16 requires cleaning.

As illustrated in FIG. 2, filter switch 52 is mounted on the exterior side of lint screen compartment 18 and is configured for determining the presence of lint screen 16 in lint screen compartment 18. The preferred filter switch 52 is a conventional single-pole switch and includes a switching element 60, a switch arm 62 and a roller 64 mounted on one end of the switch arm. Switching element 60, switch arm 62 and roller 64 cooperate to close filter switch 52 when lint screen 16 is removed from compartment 18 and open the switch when lint screen 16 is reinserted.

Switching element 60 is a conventional retractable button which opens and closes filter switch 52. Switching element 60 has two states: 1) closed to pass current, or 2) open to interrupt current. Switch arm 62 is pivotally coupled to one end of filter switch 52 and opens and closes switching element 60 in response to the position of roller 64. Roller 64 is mounted on one end of switch arm 62 and protrudes into guide rail 32a of lint screen compartment 18 when lint screen 16 is removed. When lint screen 16 is reinserted in compartment roller 64 is urged out of the compartment by support rails 24*a* of lint screen 18.

Relay assembly 53 is coupled to filter switch 52. Relay assembly 53 includes relay coil 55, electrical contacts 57 and 59, capacitor 61 and diode 63. The components of relay assembly 53 cooperate to activate enabling circuit 54 when lint screen 16 has been removed from lint screen compartment 18 and reinserted after a drying cycle.

Relay coil 55 is energized when filter switch 52 closes. As described above, switch 52 closes when lint screen 16 is removed from lint screen compartment 18. Once energized, relay coil 55 closes contact 57 and opens contact 59. While contact 57 is closed, diode 63 passes current to capacitor 61, thus charging the capacitor.

Relay coil 55 is de-energized when filter switch 52 opens. As described above, switch 52 opens when lint screen 16 is re-inserted in lint screen compartment 18. Accordingly, contact 57 opens and contact 59 closes. When contact 59 closes, capacitor 61 discharges into the latch input 72 of latching relay coil 66 as described in detail below.

Enabling circuit 54 is electrically coupled to relay assembly 53 and is configured for enabling the operation of dryer 10 when switch 52 and relay assembly 53 indicate that lint screen 16 has been removed from lint screen compartment 18 and re-inserted after a drying cycle. The preferred enabling circuit 54 is a conventional latching relay such as model number KUL11A155 available from POTTER AND BRUMFIELD and includes a latching relay coil 66 and a pair of electrical contacts 68 and 70.

Latching relay coil 66 includes a latch input 72 and a reset input 74. As illustrated in FIG. 4, latch input 72 is electrically coupled to relay assembly 53 and is activated when lint screen 16 has been removed from compartment 18 and reinserted after a drying cycle. Once activated, latching relay coil 66 latches in the energized state and remains in the energized state until reset. Reset input 74 is electrically coupled to disabling circuit 56 and resets or de-energizes latching relay coil 66 as described in detail below.

Electrical contacts 68 and 70 are electrically coupled and responsive to relay coil 66. As illustrated in FIG. 4, contact 68 is a normally open contact and is electrically coupled to dryer start button 40. When relay coil 66 is energized, contact 68 closes and provides a path of control power from the dryer power source to start button 40, thus enabling the operation of dryer 10. When relay coil 66 becomes de-energized, i.e. reset, as described in detail below, contact 68 opens and disables start button 40 and dryer 10.

Contact 70 is a normally closed contact and is electrically coupled to filter indicator light 27. Filter indicator light 27 is a conventional indicator device and is mounted to the control panel of dryer 10. When relay coil 66 is de-energized or reset, contact 70 closes and activates filter indicator light 27, indicating that dryer 10 is disabled and lint screen 16 requires cleaning. When relay coil 66 is energized, contact 70 opens and interrupts the power to indicator light 27, thus deactivating the indicator light. As illustrated in FIG. 1, a template 29 may be mounted under indicating light 27 on the control panel of dryer 10 for instructing the user to clean the lint screen when the indicating light is activated.

Disabling circuit 56 is electrically coupled between timer switch 42 and enabling circuit 54 and is configured for disabling the operation of dryer 10 after the completion of a drying cycle. Disabling circuit 56 includes control relay 73, diode 78 and capacitor 80.

Control relay 73 is a conventional relay such as model number LY2F-AC110/120 available from OMRON and includes a conventional relay coil 75 and a pair of electrical contacts 76 and 77. Relay coil 75 is electrically coupled to timer switch 42 and receives control power from the dryer power source when timer switch 42 is closed. Thus, relay coil 75 is energized when dryer 10 is in the operating mode and is de-energized when the timing cycle of timer 42 has expired.

Electrical contacts 76 and 77 are electrically coupled and responsive to relay coil 75. As illustrated in FIG. 4, contact 76 is a normally open contact and is electrically coupled between timer switch 42 and diode 78. Diode 78 is a conventional diode and is coupled between contact 76 and capacitor 80. Diode 78 passes current from contact 76 to capacitor 80 upon energization of relay coil 75, thus charging capacitor 80. When relay coil 75 becomes de-energized, i.e. timer switch 42 is opened, contact 76 opens and capacitor 80 is disconnected from the dryer power source.

Electrical contact 77 is a normally closed contact and is electrically coupled between capacitor 80 and the reset input 74 of latching relay coil 66. When relay coil 75 is energized, i.e. when dryer timer switch 42 is closed, contact 77 opens and disconnects reset input 74 from capacitor 80. When relay coil 75 is de-energized, contact 77 closes and connects capacitor 80 to reset input 74. Thus, when the drying cycle is complete, relay coil 75 is de-energized and capacitor 80 discharges its stored charge into reset input 74. The charge from capacitor 80 resets the latching relay, de-energizing relay coil 66. Accordingly, contact 68 opens and disables start button 40, and contact 70 closes and activates indicating light 27 as discussed above. Thus, the components of disabling circuit 56 cooperate to disable dryer 10 at the end of a drying cycle.

In operation, filter switch 52, enabling circuit 54 and disabling circuit 56 cooperate to disable clothes dryer 10 after a drying cycle and re-enable the dryer after lint screen 16 has been removed from lint screen compartment 18 and cleaned. To operate the dryer, the user first determines whether the lint screen has been cleaned since the last drying cycle. If indicating light 27 is activated, the user must remove lint screen 16 from lint screen compartment 18 in order to enable dryer 10. After removing lint screen 16, filter switch 52 energizes enabling circuit 54, which enables the dryer start button 40 and deactivates indicating light 27. Thus, dryer 10 is enabled for normal operation. After the completion of a drying cycle, disabling circuit 56 resets and de-energizes enabling circuit 54, disabling dryer 10. In order to complete another drying cycle, the user must repeat the lint screen cleaning step described above.

FIG. 5 illustrates an electrical circuit diagram of a second embodiment of the invention. In this embodiment, dryer control circuit 100 disables dryer 10 after the dryer has operated for a predetermined length of time. As illustrated in FIG. 5, control circuit 100 broadly includes filter switch 122, timing circuit 124 and control relay 126. In preferred forms, control circuit 100 also includes a filter indicator light 127 mounted on the control panel of dryer 10 for indicating when dryer 10 is disabled and lint screen 16 requires cleaning.

Filter switch 122 determines the presence of lint screen 16 in lint screen compartment 18. Filter switch 122 is installed on lint screen compartment 18 and operates in the same manner as filter switch 52 described in detail in the first embodiment of the invention. The preferred filter switch 122 is a conventional single-pole switch available from MICROSWITCH. Filter switch 122 is electrically coupled to timing circuit 124 for resetting the timing circuit as described in detail below.

Timing circuit 124 includes a conventional microprocessor, EPROM chip and transistor amplifier and is electrically coupled between timer switch 120 and control relay 126. Timing circuit 124 calculates the elapsed operating time of dryer 10 and energizes control relay 126 after dryer 10 has operated for a predetermined amount of time. For example, timing circuit 124 may energize control relay 126 after dryer 10 has operated for 45 minutes.

Timing circuit 124 is energized only when timer switch 120 is closed. While timing circuit 124 is energized, the microprocessor counts the elapsed operating time of dryer 10. When dryer 10 completes a drying cycle, the elapsed operating time is stored in the EPROM. When dryer 10 is operated again, the microprocessor recovers the elapsed time from the EPROM and continues counting the cumulative elapsed time. After a predetermined amount of time, timing circuit 124 energizes control relay 126.

Control relay 126 is a conventional relay such as model number LY2F-DC12 available from OMRON and includes a relay coil 128 and a pair of electrical contacts 130 and 132. Relay coil 128 is electrically coupled to timing circuit 124 and is energized after dryer 10 has operated for a predetermined amount of time.

Electrical contacts 130 and 132 are electrically coupled and responsive to relay coil 128. As illustrated in FIG. 5, contact 130 is a normally closed contact and is electrically coupled to dryer start button 118. Upon energization of relay coil 128, contact 130 closes and provides a path of control power from the dryer power source to start button 118, thus enabling the operation of dryer 10. When relay coil 128 becomes de-energized as described below, contact 130 opens and disables start button 118 and dryer 10.

As illustrated in FIG. 5, contact 132 is a normally open contact and is electrically coupled to filter indicator light 127. When relay coil 128 is energized, contact 132 closes and activates indicator light 127, indicating that dryer 10 is disabled.

Filter switch 122 re-enables dryer 10 by resetting the elapsed time count of the microprocessor of timing circuit 124. Filter switch 122 is electrically coupled to the input of timing circuit 124 and resets the timing circuit after lint screen 16 is removed from lint screen compartment 18. After lint screen 16 is replaced in compartment 18, timing circuit 124 is re-enabled and begins to recount the elapsed operating time of dryer 10.

In operation, dryer control circuit 100 disables dryer 10 after the dryer has operated for a predetermined length of time. Filter switch 122, timing circuit 124 and control relay 126 cooperate to re-enable the dryer after lint screen 16 has been removed from lint screen compartment 18.

FIG. 6 illustrates an electrical circuit diagram of a third embodiment of the invention. In this embodiment, dryer control circuit 200 disables dryer 10 either when lint screen 16 becomes clogged with lint or after the dryer has operated for a predetermined length of time. As illustrated in FIG. 6, control circuit 200 has the same components as control circuit 100 of the second embodiment of the invention shown in FIG. 5, and also includes optical sensing circuit 202 for sensing when lint screen 16 is clogged.

Optical sensing circuit 202 is coupled to timing circuit 224 and includes a conventional light emitting diode (LED) 204 and conventional phototransistor 206. LED 204 is mounted on one side of lint screen 16 for directing light through the lint screen. In preferred forms, LED 204 is positioned to direct light through the midpoint of lint screen 16. Phototransistor 206 is a conventional light detector and is mounted on the opposite side of the lint screen. Phototransistor 206 is also positioned near the midpoint of lint screen 16 to detect the light delivered by LED 204. In order to prevent ambient light from arbitrarily activating optical circuit 202, LED 204 and phototransistor 206 are selected to emit and detect a wavelength of light that differs from ambient light.

Phototransistor 206 is coupled to timing circuit 224 and produces a control signal directed to the input of timing circuit 224 in response to light received from LED 204. If lint builds up on lint screen 16, the light from LED 204 will not penetrate the screen and phototransistor 206 will not produce a control signal. In response to the elimination of the control signal at its input, timing circuit 224 energizes control relay 226 and disables dryer 10 as described in the second embodiment above.

As those skilled in the art will appreciate, LED 204 and phototransistor 206 may become inoperative due to the build up of lint on their photo-sensitive elements. To solve this problem, blowers may be installed to direct a highly focused stream of filtered air to the photosensitive elements.

In operation, dryer control circuit 200 of the third embodiment of the invention disables dryer 10 after lint screen 16 becomes clogged with lint or after the dryer has operated for a predetermined length of time. Filter switch 222, timing circuit 224 and control relay 226 cooperate to re-enable the dryer after lint screen 16 has been removed from lint screen compartment 18.

As those skilled in the art will appreciate, the preferred embodiments of the invention as described above provide numerous advantages. For example, the control circuit controls the operation of a clothes dryer and prevents the dryer from operating unless the lint screen is cleaned periodically. As a result, the dryer operates more efficiently, uses less energy, and dries clothes faster and more completely. Moreover, the invention increases the life of the dryer since less operating time is required.

As those skilled in the art will also appreciate, the present invention encompasses many variations in the preferred embodiments described herein. For example, the particular electrical components described above can be replaced with equivalent components without changing the scope of the invention.

Having thus described the preferred embodiments of the present invention, what is claimed as new and desired to be protected by Letters Patent is:

1. A clothes dryer comprising:

a laundry compartment for receiving laundry to be dried;

an air passageway coupled to said laundry compartment for circulating heated air generated by the clothes dryer in and out of said laundry compartment;

a lint screen compartment interposed in said air passageway;

a lint screen adapted to be received in said lint screen compartment for filtering the circulated heated air;

a control circuit configured for controlling the operation of the dryer, said control circuit including means for preventing the dryer from operating unless said lint screen is removed from said lint screen compartment and re-inserted after a drying cycle.

2. The clothes dryer as set forth in claim 1, said control circuit including switch means for determining the presence of said lint screen in said lint screen compartment.

3. The clothes dryer as set forth in claim 2, said control circuit including enabling means coupled and responsive to said switch means for enabling the operation of the clothes dryer when said switch means determines that said lint screen has been removed from said lint screen compartment and re-inserted after a drying cycle.

4. The clothes dryer as set forth in claim 3, said control circuit including disabling means coupled to said enabling means for disabling the dryer after completion of each drying cycle, wherein said disabling means is configured for disabling the dryer until said switch means determines that said lint screen has been removed from said lint screen compartment and re-inserted after a drying cycle.

5. The apparatus as set forth in claim 4, wherein said switch means, disabling means and enabling means cooperate to disable the clothes dryer after a drying cycle and re-enable the dryer after said lint screen has been removed from said lint screen compartment and re-inserted.

6. The apparatus as set forth in claim 4, said control circuit including an indicating means for indicating when said control circuit has disabled the dryer.

7. The dryer as set forth in claim 6, said switch means including a single-pole filter switch having open and closed states, wherein said filter switch is closed when said lint screen is removed from said lint screen compartment and open when said lint screen is replaced in said lint screen compartment.

8. The apparatus as set forth in claim 7, said enabling means including a latching relay having a latched state and a reset state, wherein said latching relay is energized in said latched state and de-energized in said reset state.

9. The apparatus as set forth in claim 8, wherein said latching relay is energized when said filter switch is closed and subsequently opened, and said latching relay is de-energized when said disabling means is energized.

10. The apparatus as set forth in claim 9, said latching relay including first and second electrical contacts, wherein said first contact is normally open and coupled to a dryer start button for disabling the dryer start button when said latching relay is de-energized, and said second contact is normally closed and coupled to said indicating means for activating said indicating means when said latching relay is de-energized.

11. The apparatus as set forth in claim 10, said first contact configured to close and enable the dryer start button when said latching relay is energized, said second contact configured to open and deactivate said indicating means when said latching relay is energized.

12. The apparatus as set forth in claim 11, said disabling circuit means including a control relay and a capacitor.

13. The apparatus as set forth in claim 12, said control relay including first and second electrical contacts.

14. The apparatus as set forth in claim 13, wherein said control relay is energized when the dryer is operating during a drying cycle and de-energized after the completion of a drying cycle.

15. The apparatus as set forth in claim 14, wherein said first electrical contact of the control relay is coupled to said capacitor and is closed for delivering a current for charging said capacitor when said control relay is energized, and said second contact of the control relay is interposed between said capacitor and said latching relay and is open when said control relay is energized.

16. The apparatus as set forth in claim 15, wherein said first contact of the control relay is open and said second contact of the control relay is closed when said control relay is de-energized, and wherein said second contact of the control relay delivers the charge stored in said capacitor to said latching relay when said control relay is de-energized, wherein said charge resets and disables said latching relay.

17. A control circuit for use in a clothes dryer having a lint screen, a lint screen compartment for receiving the lint screen, a start button and a timer for allowing the dryer to operate for a drying cycle, said control circuit configured for controlling the operation of the dryer, said control circuit comprising:

switch means for determining the presence of the lint screen in the lint screen compartment;

enabling circuit means coupled to and responsive to said switch means for enabling the operation of the clothes dryer when said switch means determines that the lint screen has been removed from said lint screen compartment and re-inserted after a drying cycle; and disabling circuit means coupled to the timer and said enabling circuit means for disabling the dryer after the completion of a drying cycle.

18. The apparatus as set forth in claim 17, wherein said switch means, disabling circuit means and enabling circuit means cooperate to disable the clothes dryer after a drying cycle and re-enable the dryer after the lint screen has been removed and cleaned.

19. The apparatus as set forth in claim 18, said control circuit including an indicating means for indicating when said control circuit has disabled the dryer.

* * * * *